US010264873B2

(12) United States Patent
Grote

(10) Patent No.: US 10,264,873 B2
(45) **Date of Patent: *Apr. 23, 2019**

(54) ARM BAND CASE FOR PORTABLE ELECTRONIC DEVICE

(71) Applicant: Griffin Technology, LLC, Irvine, CA (US)

(72) Inventor: Paul S. Grote, Hampton, NH (US)

(73) Assignee: Griffin Technology, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/936,887

(22) Filed: Mar. 27, 2018

(65) Prior Publication Data

US 2018/0213922 A1 Aug. 2, 2018

Related U.S. Application Data

(63) Continuation of application No. 15/662,085, filed on Jul. 27, 2017, now Pat. No. 9,955,775, which is a (Continued)

(51) Int. Cl.

| | |
|---|---|
| ***A45F 5/00*** | (2006.01) |
| ***A45C 11/00*** | (2006.01) |
| ***A45C 13/00*** | (2006.01) |
| ***A45C 13/10*** | (2006.01) |
| ***F21V 33/00*** | (2006.01) |

(Continued)

(52) U.S. Cl.

CPC ..... *A45F 5/00* (2013.01); *A45C 11/00* (2013.01); *A45C 13/002* (2013.01); *A45C 13/10* (2013.01); *A45C 15/06* (2013.01); *F21V 33/0004* (2013.01); *A45C 2011/001* (2013.01); *A45C 2011/002* (2013.01); *A45C 2011/003* (2013.01); *A45C 2013/1015* (2013.01); *A45F 2005/008* (2013.01); *A45F 2200/0516* (2013.01); *F21Y 2115/10* (2016.08)

(58) Field of Classification Search

CPC ..... A45F 5/00; A45F 2200/0516; A45F 2005/008; A45C 11/00; A45C 13/002; A45C 13/10; A45C 2011/001; A45C 2011/002; A45C 2011/003; A45C 2013/1015; F21V 33/0004; F21Y 2115/10

USPC ..... 224/219–222

See application file for complete search history.

(56) References Cited

U.S. PATENT DOCUMENTS 5,657,201 A * 8/1997 Kochis ..... G06F 1/163 224/219

6,330,961 B1 * 12/2001 Borja ..... A45C 1/04 224/221

(Continued)

*Primary Examiner* — Corey N Skurdal

(74) *Attorney, Agent, or Firm* — Manatt, Phelps & Phillips, LLP

(57) ABSTRACT

An arm band case for portable electronic device is disclosed. The arm band case may be secured to the user with straps and includes a pocket having a transparent window that provides visibility to the touchscreen of the electronic device and a plurality of powered light sources that are configured to illuminate the arm band and thereby provide added visibility to the user when in use. The arm band case is formed of multiple layers that encapsulate the light sources while allowing access to the battery housed therein and while facilitating the transmission and dispersion of light to illuminate the arm band.

20 Claims, 8 Drawing Sheets

Related U.S. Application Data continuation of application No. 15/275,258, filed on Sep. 23, 2016, now Pat. No. 9,743,743.

(60) Provisional application No. 62/222,854, filed on Sep. 24, 2015.

(51) Int. Cl.
*A45C 15/06* (2006.01)
*F21Y 115/10* (2016.01)

(56) References Cited

U.S. PATENT DOCUMENTS 6,629,628 B1 * 10/2003 Canepari ..... A45C 1/04 150/112
8,752,740 B2 * 6/2014 Morgan ..... A45F 5/00 224/222
9,516,940 B2 * 12/2016 Lowry ..... A45F 5/00
2005/0145657 A1 * 7/2005 Norberg ..... A45F 5/02 224/222
2007/0095871 A1 * 5/2007 Chen ..... A45F 5/00 224/219
2007/0215663 A1 * 9/2007 Chongson ..... A45C 1/04 224/650
2008/0017678 A1 * 1/2008 Anderson ..... A44C 5/003 224/221
2009/0057357 A1 * 3/2009 Rohrbach ..... A45F 5/00 224/222
2010/0032462 A1 * 2/2010 Cameron ..... A45C 11/00 224/222
2010/0327030 A1 * 12/2010 Yang ..... A45F 5/00 224/199
2014/0361057 A1 * 12/2014 Gardner ..... A45F 5/00 224/222
2015/0289615 A1 * 10/2015 Welsch ..... G06F 1/163 224/219
2016/0106201 A1 * 4/2016 Taylor ..... A45F 5/00 224/222
2016/0174674 A1 * 6/2016 Oberpriller ..... A45F 5/021 224/222

* cited by examiner

ARM BAND CASE FOR PORTABLE ELECTRONIC DEVICE

INCORPORATION BY REFERENCE TO RELATED APPLICATIONS

This application is a continuation of U.S. application Ser. No. 15/662,085, filed on Jul. 27, 2017, which is a continuation of U.S. application Ser. No. 15/275,258, filed on Sep. 23, 2016, which claims benefit under 35 U.S.C. § 119(e) from U.S. Provisional Application No. 62/222,854, filed on Sep. 24, 2015. All of the above applications are hereby incorporated herein by reference in their entirety.

BACKGROUND OF THE INVENTION

Field of the Invention

This patent document relates to protective enclosures or cases for mobile electronic devices and more particularly to such cases that are configured to be strapped to a user's limb and illuminated.

Description of the Related Art

Mobile electronic devices with interactive touch screen interfaces such as smart phones, PDA, MP3 players, computing tablets and the like have become ubiquitous in today's society. As functionality and features sets of these devices expand and become more and more integral to our lives, users are increasingly carrying such devices during work and recreational activities (e.g., running, biking, skiing, playing sports, working with hands, etc.) to stay connected while monitoring their activities. Carrying the device in a pocket can be uncomfortable, detract from the activity being performed, and make it inconvenient or difficult to readily interface with and/or monitor the functionalities of the device while performing the activity. Moreover, it is not uncommon for users to participate in such activities at night or in other low-light or dark conditions where the user may not be readily seen by motorists and others and thereby expose the user to unsafe conditions that can lead to accidents.

It is here recognized, therefore, that there is a need to develop a comfortable protective case for such mobile electronic devices that is capable of providing the user with convenient access to the device while providing illumination to increase visibility of the user to motorists and others and thereby mitigate against accidents.

SUMMARY OF THE INVENTION

Disclosed are numerous aspects of a unique and inventive protective case configured to receive, retain and protect a mobile device. The case may be configured for a mobile electronic device that is in the form of a tablet, a smart or mobile phone, an MP3 audio player, a gaming device, or other portable handheld electronic or computing device and may have one or more touchscreens on its front face and/or back face and one or more biometric sensors or fingerprint scanners.

The protective case is configured to house the electronic device in a transparent pocket while also be illuminated on its outer surface by an internal light source, such as plurality of light emitting diodes. The illumination enhances visibility at night or in other low-light or dark conditions where the user may not be readily seen by motorists and others and thereby is capable of mitigating against accidents. The transparent pocket allows visibility to and interaction with the electronic device without the user removing the device from the case.

Aspects, shown in the illustrated implementation, include a protective case being comprised of a multi-layered arm band having a front face and an opposing back face and extending from a first end section to a second end section with a mid-section residing there between. The arm band being configured to be wrapped around a user's arm and adjustably secured thereto. The arm band includes a pocket formed in the mid-section. The pocket is dimensioned to receive and house the portable electronic device and may include a transparent screen window on the front face that is configured to provide visibility to the touchscreen of the electronic device when the device is housed within the pocket. The pocket may also include an aperture that allows for user interaction with a fingerprint scanner on the electronic device. A strap is provided at the first end section that is dimensioned to being received through one or more rings provided in the second end section and configured to being secured into a fixed position via a fastener, such as a loop and hook Velcro® type fastener. The arm band further includes a lighting assembly comprising a plurality of light sources electrically connected to and powered by battery. The arm band is configured so that the light sources illuminate the exterior front face of the arm band.

Additional aspects includes a front face of the arm band case being comprised of a front panel that is configured to facilitate the dispersion of light. One or more patterns of apertures or slots may be provided to allow the light emitted from the light sources to escape and illuminate the exterior of the arm band.

Yet additional aspects includes a construction of the front panel that includes varied or faded thicknesses that tend to thin-out extend outward from the pocket toward the perimeter edges of the arm band case, which may further facilitate dispersion of light or illumination of the arm band case in a more desirable way.

In yet additional aspects, the light sources may be mounted into a transparent polymer sheet that may facilitate piping of the light through the arm band. The transparent sheet may include etched or textured regions that may further assist in the manner by which the light illuminates the arm band. The etched/textured regions may be formed in patterns that correspond the slotted patterns in the front face panel.

In yet additional aspects, the light sources can be directionally configured and mounted on a flexible printed circuit board and electrically connected to the battery via a cable that is connected to a battery housing via a strain relief component.

In yet other aspects, the battery housing can include a removable battery access cover on one side and a button on the opposite side. The arm band can be configured to interface with the battery housing button and provide access to the removable battery access cover.

Yet other aspects relate to the manufacture, construction, configuration, and attachment of the constituent components of the multi-layered construction of the arm band case and the manner by which light assembly is positioned and housed therein.

It should be understood that each of the foregoing and various aspects, together with those set forth in the claims and summarized above or otherwise disclosed herein, including the drawings, may be combined to form claims for a device, apparatus, system, method of manufacture, and/or use without limitation.

BRIEF DESCRIPTION OF THE DRAWINGS

These and other features, aspects and advantages are described below with reference to the drawings, which are intended to illustrate but not to limit the invention. In the drawings, like reference characters or numerals denote corresponding features consistently throughout disclosed embodiments.

Figure 1A:
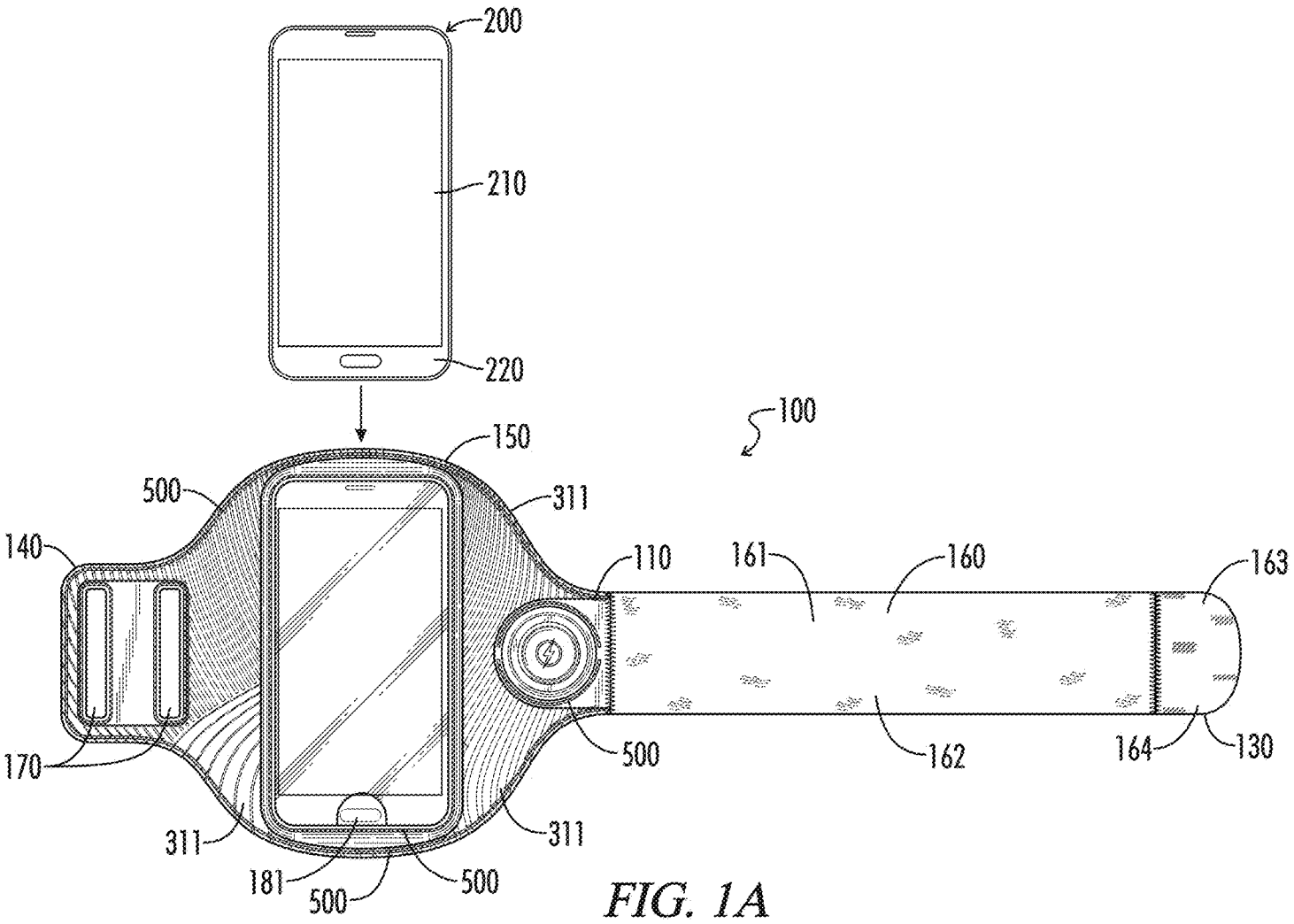
FIG. 1A is a front face view of the arm band portable electronic device case illustrating insertion of an electronic device into the pocket of the case.
Figure 1B:
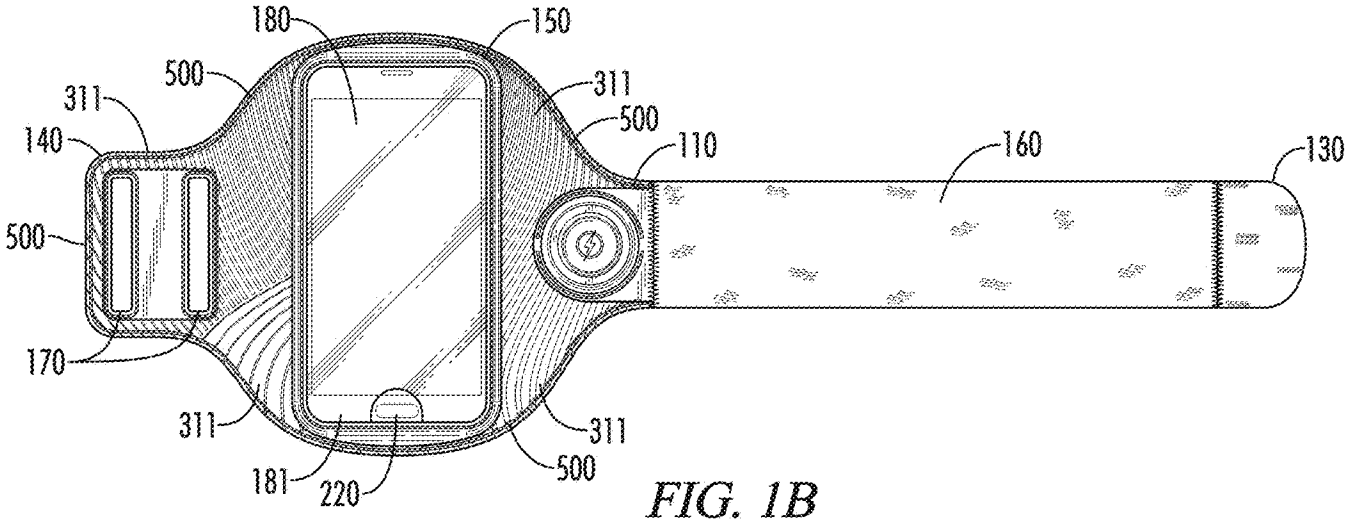
FIG. 1B is a front face view of the arm band portable electronic device case depicted in FIG. 1A. with the electronic device inserted into the pocket of the case.
Figure 1C:
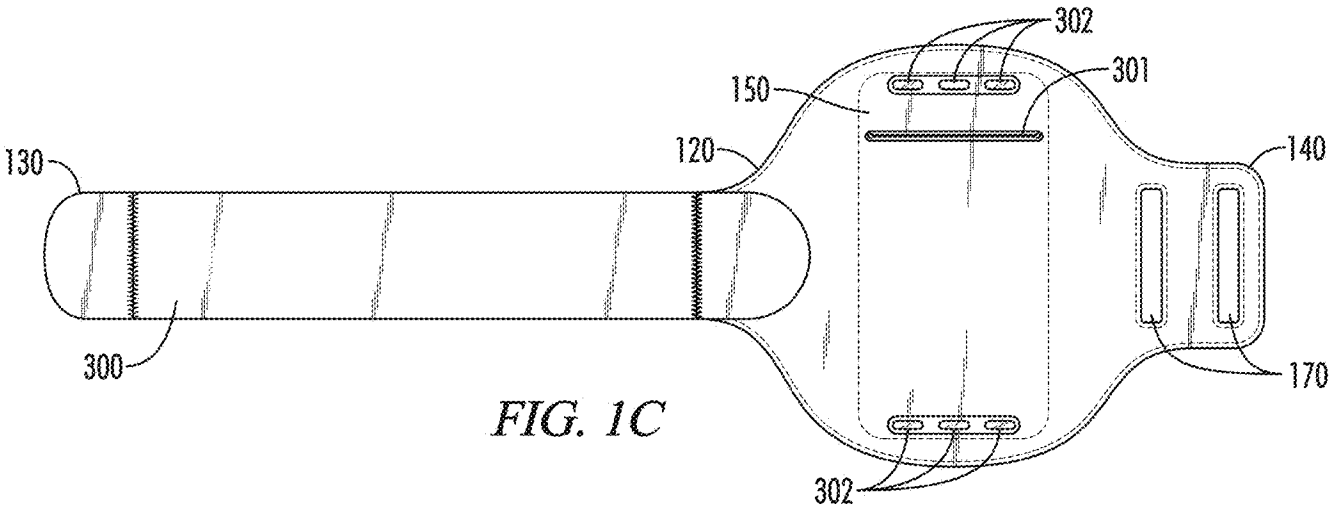
FIG. 1C is a back face view of the arm band portable electronic device case depicted in FIG. 1A-B.

Each drawing is generally to scale and hence relative dimensions of the various layers can be determined from the drawings.

DETAILED DESCRIPTION OF THE PREFERRED EMBODIMENT

As summarized above and illustrated in the drawings, disclosed herein are various aspects of a protective case for a mobile device capable of providing additional reinforcing support to mitigate or prevent bending of the device while minimizing bulkiness and weight, yet maintaining a high level of protection. Aspects of which are summarized above and illustrated in the drawings.

As set forth above, FIGS. 1-11 illustrate various views and constituent components of an arm band portable electronic device case 100. The drawings illustrate, by way of example only, various of the configuration and construction aspects of the case. In the particular implementation illustrated, the case is configured for Samsung Galaxy 5S® mobile or smart phone device 200, which includes a touchscreen 210 and a biometric fingerprint sensor or scanner 220 on the front surface thereof. It should be understood, however, that the case 100 may be configured for any mobile or electronic device, including but not limited to portable or cellular phones, PDAs, MP3 or audio/video devices, gaming devices, or computing tablets or devices.

As illustrated in the drawings the case 100 is in the form of an arm band adapted to being wrapped around a user's arm and adjustably secured thereto. It is generally comprised of a multi-layered structure having a front face 110 and an opposing back face 120 and extends from a first end section 130 to a second end section 140 with a mid-section 150 residing there between and as described below includes battery powered light sources that are capable of illuminating the exterior of the case 100.

As best illustrated in FIGS. 1A to 2B, a strap 160 is provided at the first end section 130 that is configured to be received through one or more rings 170 in the second end section 140 and secured into a fixed position via a fastener, which in the illustrated embodiment is a loop and hook fastener configured to adhere to one another when pressed together such as that marketed under the Velcro® brand. The strap 160 includes a first region 161 comprising a panel 162 having plurality of loops and a second region 163 comprising a panel 164 of a plurality of hooks. The first region 161 being positioned nearer the second end section 140 than said second region 163. Passing the strap 160 through the ring 170 and folding it over itself allows for the panel of hooks 164 at the end of the strap 160 to be positioned over and facing the panel of loops 162 such that when the two panels are pressed together they adhere to one another and thereby fix the position of the strap 160.

The front face 110 includes a transparent screen window 180 that is configured to overlie the touchscreen of the smart phone 200 when the smart phone 200 is positioned within a pocket 190 formed between the transparent screen window 180 and a base panel 300 (best illustrated in FIGS. 1C and 2B) that forms the back face 120 of the case 100. The base panel 300 includes a pocket opening 301 that extends through the base panel 300 into the pocket 190 and is dimensioned to allow the portable electronic device 200 to pass into and out of the pocket 190. The transparent screen window 180 may further include an aperture 181 configured to overlie the fingerprint scanner 220 when the device is positioned within the pocket 190. The base panel 300 may also include one or more apertures or openings 302 that extend into the pocket 190 that may serve to facilitate functionality of the portable electronic device 200.

Figure 2A:
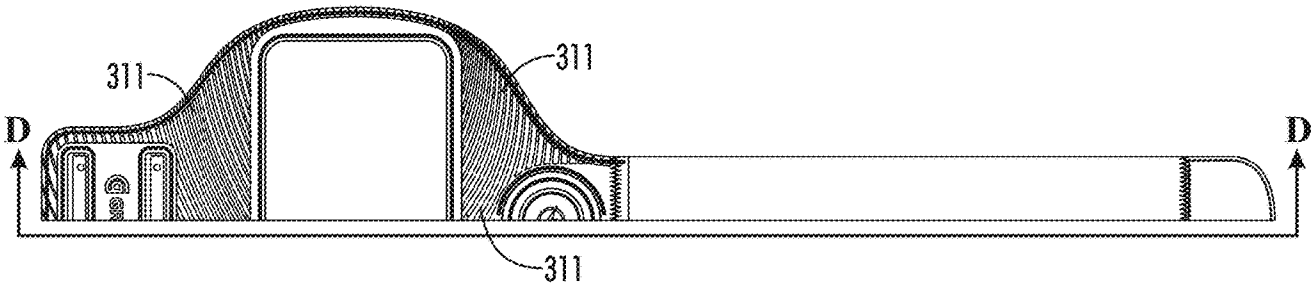
FIG. 2A is a partial front face view of the arm band portable electronic device case depicted in FIG. 1A illustrating the location of cross section line D-D.
Figure 2B:
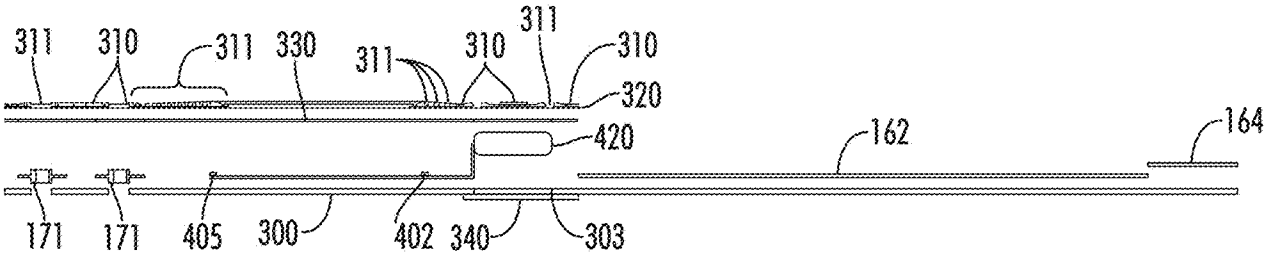
FIG. 2B is an exploded cross-sectional view of the arm band portable electronic device case taken a long cross-section line D-D illustrating the various components of the case.
Figure 3:
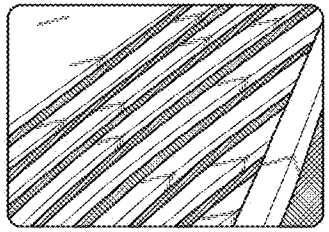
FIG. 3 is a close-up view of a representation of the slotting in the front panel of the arm band portable electronic device case revealing the mesh substrate bonded thereto.
Figure 4A:
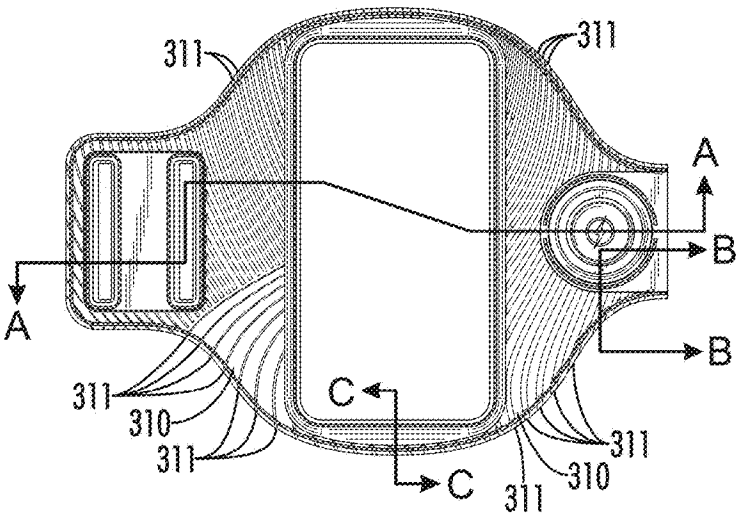
FIG. 4A is a diagram of the front panel and mesh substrate components of the arm band portable electronic device case illustrated in FIG. 1A. The diagram further illustrates the location of cross-section lines A-A, B-B, and C-C and provides dimensions for those components for a case configured to receive and house a Samsung Galaxy 5S® mobile or smart phone.
Figure 4C:
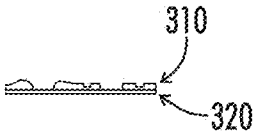
FIGS. 4B-4D are diagrams illustrating more detailed cross-sectional views of the front panel and mesh substrate components of the arm band portable electronic case taken along cross-section lines A-A, B-B, and C-C of FIG. 4A, respectively.
Figure 4D:
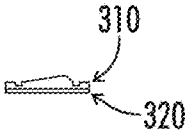
Figure 4B:
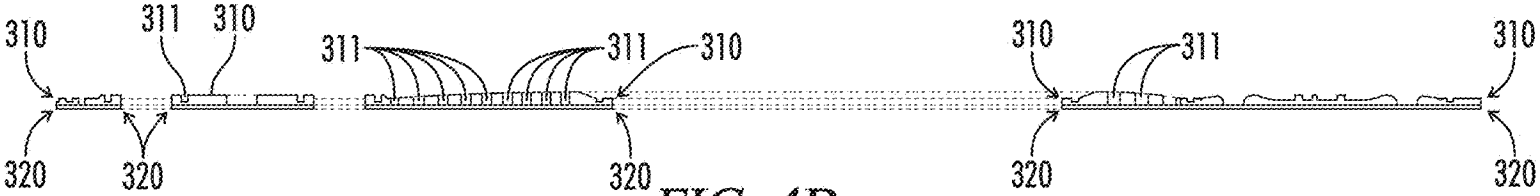
Figure 10:
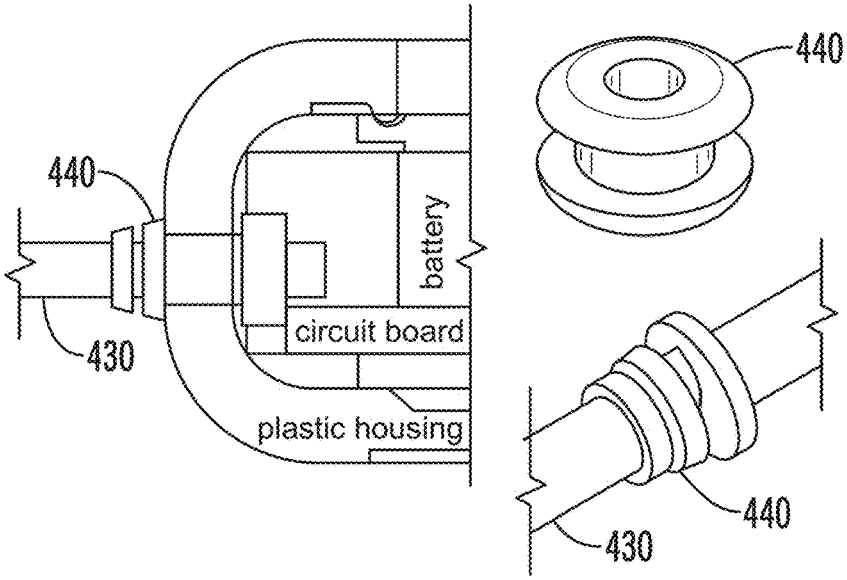
FIG. 10 is an illustration and close up views of the strain relief component that connects the battery housing to the cable.

As best illustrated in FIGS. 2A and 2B, the case 100 is comprised of a multi-layered structure that includes the base panel 300 that extends from the first end section 130 to the second end section 140, a front panel 310 bonded to a mesh substrate 320 that extends from the second end section 140 to the mid-section 150, a transparent polymer layer 330 that forms the transparent screen window 180 and adjacent regions 338 thereto, and a plurality of LED light sources 401, 402, 403, 404, 405, 406 mounted on flexible printed circuit board and electrically connected via a cable 430 to a battery 410 contained within a housing 420 having a removable battery access cover 421 on one side and a button 422 on the opposite side. As best illustrated in FIG. 10 the cable 430 may be connected to the battery housing 420 via a strain relief component 440 interposed there-between.

Figure 11:
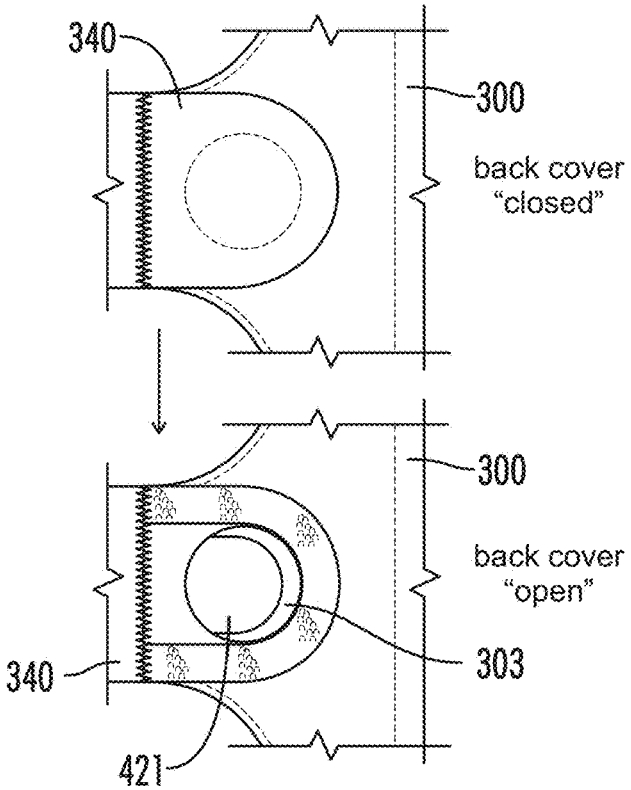
FIG. 11 is an illustration of the back cover to the battery housing in the closed and open position.

In addition to the pocket opening 301 described above, the base panel 300 (as well as the overlying layers) also includes openings for each of the two rings 170, which in the present embodiment are defined by polymer D-ring structures 171, and a battery access opening 303, which is covered by a back cover 340 that is connected to the back panel 300 and movable from a closed position to an open position as best illustrated in FIG. 11. When the back cover 340 is in the closed position, the back cover 340 overlies the battery access opening 303 in the arm band to the battery housing 420. In the open position the back cover 340 is displaced from the battery access opening 303, relative to its position in the closed position, to allow access to the battery housing 420 and the removable battery access cover 421 so that the user can access the battery 410 contained therein. The battery housing may be made of plastic. The base panel 300 and back cover 340 may be formed of synthetic polymer such as neoprene or SBR coated spandex, or other suitable material.

The front panel 310 includes a front side and an opposing underside with the underside being bonded to the mesh substrate layer 320. The front panel 310 further includes a pattern of slots 311 extending there-through that reveal the underlying mesh substrate 320. The patterns of slots 311 and the thicknesses are best illustrated in FIGS. 1A-1B, 2A, 3, 4A and the cross-sectional views depicted in FIGS. 2B, and 4B-4D. Notably, the thickness of the front panel 310 (between the front side and the underside of the front panel) is not uniform but rather may include one or more faded regions that thin-out the front panel 300 as it extends along its slots outward from the pocket 190 toward the perimeter edges of the case 100, which may facilitate dispersion of light so as to more desirably illuminate the case 100. The front panel may be made of a polymer, such as poured polyurethane (PU).

Figure 5:
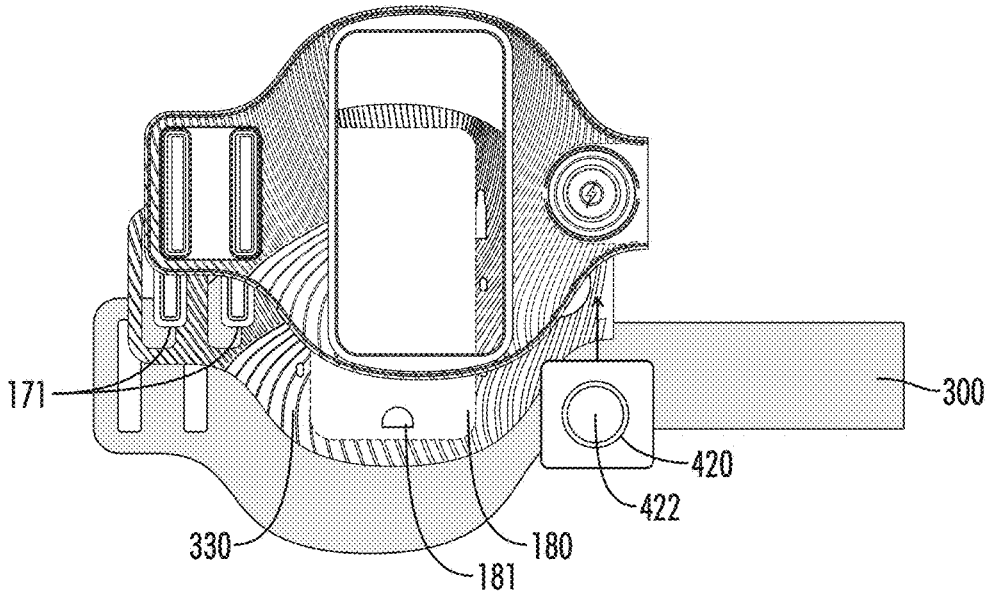
FIG. 5 is a diagram of illustrating the lay-up of the arm band portable electronic device case illustrated in FIG. 1A. The diagram illustrates the base panel, the transparent polymer layer that forms the transparent screen window and adjacent regions thereto, and the front panel mounted to the mesh substrate as well as the positioning and orientation of the battery housing.
Figure 6:
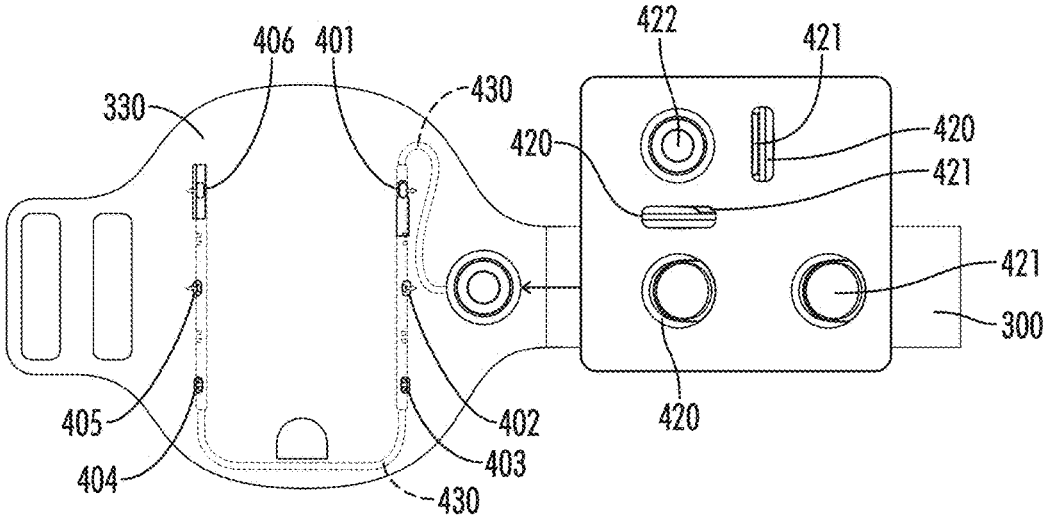
FIG. 6 is a diagram illustrating the positioning of the light sources and battery housing and electrical connections therebetween on the adjacent regions of the transparent polymer layer, which is positioned at top the base panel of the of the arm band portable electronic device case illustrated in FIG. 1A.
Figure 7:
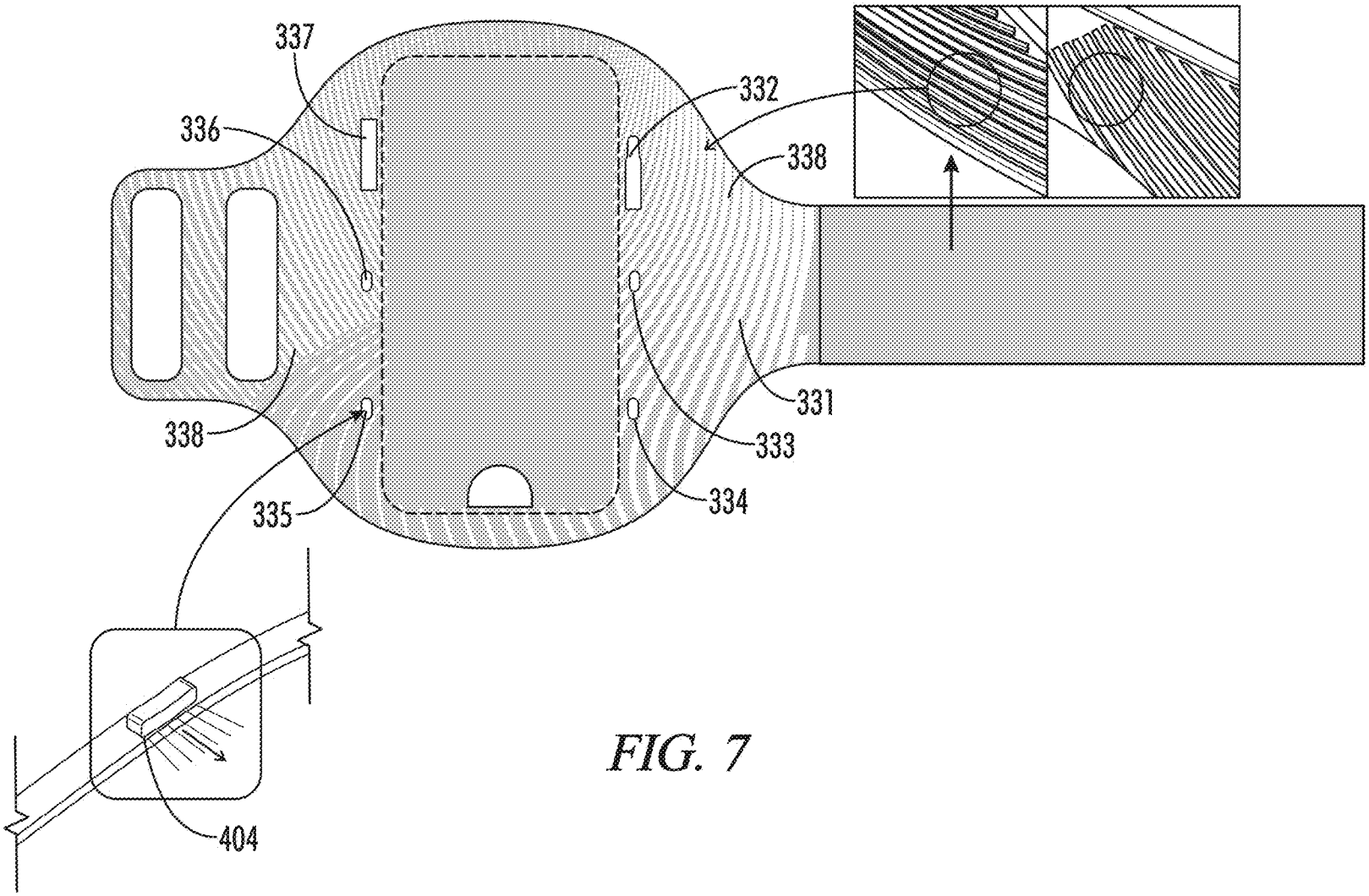
FIG. 7 is a diagram illustrating the transparent polymer layer positioned over the base panel of the of the arm band portable electronic device case illustrated in FIG. 1A. The diagram provides a more detailed illustration of the pattern of etching that creates a texture on the surface of the adjacent regions of the transparent polymer layer that corresponds with the slotted pattern on the front panel. Close-up views are provided of the side light emitting diode (LED) light sources, which when powered emit light sideways into the side of the transparent polymer layer, which can result in achieving a light pipe effect.
Figure 8:
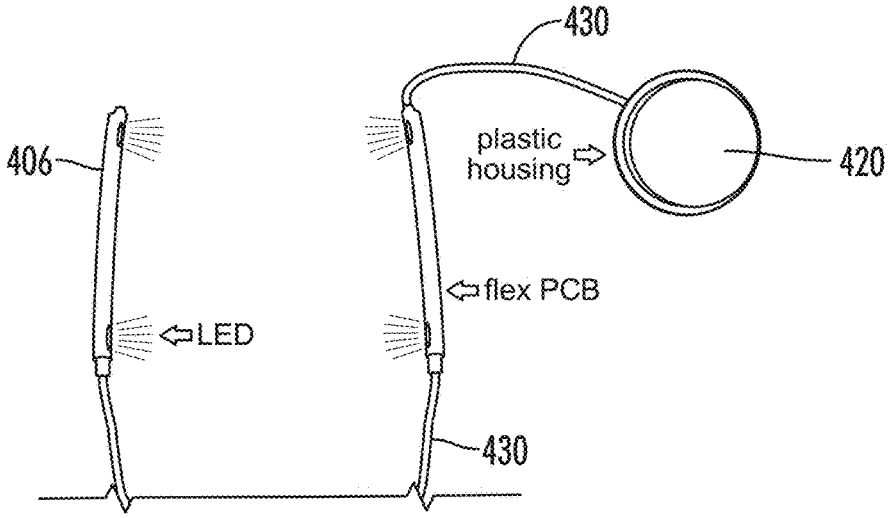
FIG. 8 is a close-up view of the light and battery housing assembly illustrating the LED light sources mounted to flexible printed circuit boards and connected to the battery housing.
Figure 9:
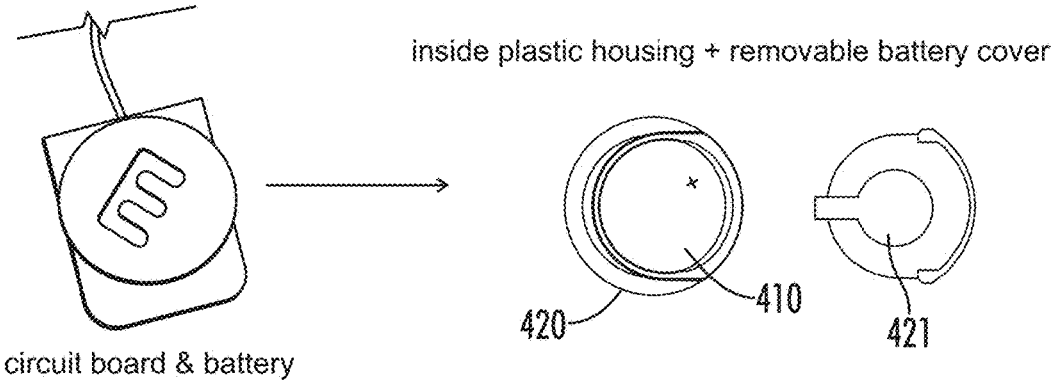
FIG. 9 are additional close-up views of the battery housing assembly including the circuit board, the battery, and the removable battery cover.

As best illustrated in FIGS. 7 and 5, the transparent polymer layer 330, which is located over the base panel 300 and under the front panel and mesh substrate 310, 320, may further include etching that creates a texture on the surface of the adjacent regions next to the transparent screen window 180 of the transparent polymer layer 330. The etching is configured to correspond with the slotted patterns 311 on the front panel. The transparent polymer layer 330 may be formed of thermo plastic polyurethane (TPU) that can meet anti-fog standards at 60 degrees temperature, 95% humidity for a period of 72 hours.

The electrical assembly components (e.g., LEDs, battery housing) are positioned within corresponding apertures 331-337 disposed on the transparent polymer layer 330 (best depicted in FIGS. 6 and 7) so that they are housed between the front panel 310 and mesh substrate 320 on the front side of the case 100 and the base panel 300 on the back side of the case 100. The base panel 300, front panel 310, mesh substrate 320, the transparent polymer layer 330 are attached to each other via stitching 500 (best depicted in FIGS. 1A and 1B) such that the electrical components reside in compartments defined by the stitched layers. When the LEDs 401-406 are positioned within the apertures of the transparent polymer layer 330 and powered light is emitted sideways away from the pocket 190 and into the adjacent regions of the transparent polymer layer, which in turn may serve to create a light pipe effect. The combination of the slotted regions and the fading thickness of the front panel 310 together with the light pipe effect of the transparent polymer layer 330 serves to allow light emitted by the internally positioned LEDs to illuminate the front face 110 of the case 100.

Each of the foregoing and various aspects, or teachings herein together with those set forth in the claims and described in connection with the embodiments of the protective cases summarized above or otherwise disclosed herein including the drawings and the written description may be combined to form claims for a device, apparatus, system, method of manufacture, and/or use without limitation.

Although the various inventive aspects are herein disclosed in the context of certain preferred embodiments, implementations, and examples, it will be understood by those skilled in the art that the present invention extends beyond the specifically disclosed embodiments to other alternative embodiments and/or uses of the invention and obvious modifications and equivalents thereof. In addition, while various aspects have been shown and described in detail, modifications of such aspects will be readily apparent to those of skill in the art based upon this disclosure. It should be also understood that the scope of this disclosure includes the various combinations or sub-combinations of the specific features and aspects of the embodiments disclosed herein, such that the various features, modes of implementation, and aspects of the disclosed subject matter may be combined with one another in whole or in part. Thus, it is intended that the scope of the present invention herein disclosed should not be limited by the particular disclosed embodiments or implementations described above, but should be determined only by a fair reading of the claims.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Claims are hereby expressly incorporated into this Detailed Description, with each claim standing on its own as a separate embodiment.

What is claimed is:

1. An arm band case for portable electronic devices, the arm band case comprising:

a multi-layered arm band having a first end section, a second end section, a mid-section located between the first end section and the second end section, a base panel extending from the first end section to the second end section, a front panel having a front side and an opposing underside bonded to a mesh substrate that extending from the second end section to the mid-section, and a transparent layer forming a transparent screen window and adjacent regions thereto;

a pocket formed in the mid-section and dimensioned to receive and house a portable electronic device;

a battery; and a plurality of light sources electrically connected to and powered by the battery, wherein light emitted from the light sources sideways away from the pocket and into the adjacent regions of the transparent layer.

2. The arm band case of claim 1, wherein thickness of the front panel between the front side and the underside is not uniform.

3. The arm band case of claim 1, wherein the front panel includes one or more faded regions that thin-out the front panel as it extends along a pattern of slots outward from the pocket toward at least one of a plurality of perimeter edges of the case.

4. The arm band case of claim 1, wherein the front panel includes a pattern of slots extending there-through that reveal the underlying mesh substrate.

5. The arm band case of claim 4, wherein the adjacent regions include a textured pattern that corresponds in position and shape with the pattern of slots of the front panel.

6. The arm band case of claim 1, wherein the front panel, the mesh substrate, and the transparent polymer layer are secured to the base panel by stitching.

7. The arm band case of claim 1, wherein the pocket is defined between the transparent screen window and a back face of the arm band, wherein the back face is defined by the base panel, wherein the base panel includes a pocket opening that extends through the base panel into the pocket.

8. The arm band case of claim 1, wherein the battery is housed in a battery housing, and wherein a first side of the battery housing is adhered to the underside of the front panel.

9. The arm band case of claim 1, wherein the plurality of light sources are mounted on one or more flexible printed circuit boards.

10. The arm band case of claim 1, wherein the plurality of light sources include one or more light emitting diodes.

11. The arm band case of claim 10, wherein the light emitting diodes are configured to emit light away from the transparent window screen toward both the second end section and first end section of the arm band.

12. An arm band case for portable electronic devices, the arm band case comprising:

a multi-layered arm band having a base panel having a first end section, a second end section, a mid-section located between the first end section and the second end section, a front panel having a front side and an opposing underside bonded to a mesh substrate that extending from the second end section to the mid-section, and a transparent polymer layer forming a transparent screen window and adjacent regions thereto;

a pocket formed in the mid-section and dimensioned to receive and house the portable electronic device;

a battery; and a plurality of light sources electrically connected to the battery and configured to be powered by the battery.

13. The arm band case of claim 12, wherein thickness of the front panel between the front side and the underside is not uniform.

14. The arm band case of claim 12, wherein the front panel includes one or more faded regions that thin-out the front panel as it extends along a pattern of slots outward from the pocket toward at least one of a plurality of perimeter edges of the case.

15. The arm band case of claim 12, wherein the front panel includes a pattern of slots extending there-through that reveal the underlying mesh substrate.

16. The arm band case of claim 15, wherein the adjacent regions include a textured pattern that corresponds in position and shape with the slotted regions of the front panel.

17. An arm band case for portable electronic devices, the arm band case comprising:

an arm band having a front face, a back face, a first end section, a second end section, a mid-section residing between the first end section and the second end section, and a transparent polymer layer forming a transparent screen window and adjacent regions thereto, the front face having a pattern of slots extending there-through that reveal a underlying mesh substrate;

a pocket formed in the mid-section and dimensioned to receive and house the portable electronic device;

a battery;

a plurality of light sources electrically connected to the battery and configured to be powered by the battery; and a strap at the first end section and is configured to be received through one or more rings in the second end section and secured into a fixed position via a fastener.

18. The arm band case of claim 17, wherein the adjacent regions include a textured pattern.

19. The arm band case of claim 17, wherein the plurality of light sources include one or more light emitting diodes.

20. The arm band case of claim 19, wherein the light emitting diodes are configured to emit light away from a transparent window screen toward both the second end section and first end section of the arm band.

* * * * *